US010335927B2

(12) United States Patent
Fukui et al.

(10) Patent No.: US 10,335,927 B2
(45) Date of Patent: Jul. 2, 2019

(54) CLAMP APPARATUS

(71) Applicant: SMC CORPORATION, Chiyoda-ku (JP)

(72) Inventors: Chiaki Fukui, Abiko (JP); Kazuyoshi Takahashi, Koto-ku (JP); Hideki Sasaki, Toride (JP); Masaharu Kobayashi, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 476 days.

(21) Appl. No.: 14/903,222

(22) PCT Filed: Jul. 10, 2014

(86) PCT No.: PCT/JP2014/068967
§ 371 (c)(1),
(2) Date: Jan. 6, 2016

(87) PCT Pub. No.: WO2015/012178
PCT Pub. Date: Jan. 29, 2015

(65) Prior Publication Data

US 2016/0129559 A1 May 12, 2016

(30) Foreign Application Priority Data

Jul. 23, 2013 (JP) ..... 2013-152372

(51) Int. Cl.
*B25B 1/08* (2006.01)
*B25B 5/06* (2006.01)
*B25B 5/16* (2006.01)

(52) U.S. Cl.
CPC ..... *B25B 5/064* (2013.01); *B25B 5/16* (2013.01)

(58) Field of Classification Search
USPC ..... 269/32, 38, 228, 229
See application file for complete search history.

(56) References Cited

U.S. PATENT DOCUMENTS

| | | | | |
|---|---|---|---|---|
| 4,494,739 | A | 1/1985 | Valentine | |
| 2004/0113343 | A1* | 6/2004 | McIntosh | B25B 5/087 269/32 |
| 2016/0136789 | A1* | 5/2016 | Fukui | B25B 5/064 269/32 |

FOREIGN PATENT DOCUMENTS

| | | | | |
|---|---|---|---|---|
| CN | 201471307 | * | 5/2010 | B23Q 3/06 |
| CN | 201471307 U | | 5/2010 | |
| JP | 4950123 B2 | | 6/2012 | |

OTHER PUBLICATIONS

International Search Report dated Oct. 6, 2014 in PCT/JP14/068967 Filed Jul. 10, 2014.

(Continued)

*Primary Examiner* — Joseph J Hail
*Assistant Examiner* — Shantese McDonald
(74) *Attorney, Agent, or Firm* — Oblon, McClelland, Maier & Neustadt, L.L.P.

(57) ABSTRACT

A clamp apparatus including first and second clamp arms, which are supported rotatably on a body, with a cover being installed to cover outer sides of the body. The cover includes openings through which portions of the first and second clamp arms are inserted and rotatably operated. An unloading tray is arranged in the body at a position below the openings in the direction of gravity. Spatter, which invades into the clamp apparatus from the openings when a welding operation is carried out on a workpiece that is clamped by the first and second clamp arms, is deposited on the unloading tray, and the spatter is eliminated by taking out the unloading tray to the exterior of the clamp apparatus.

7 Claims, 5 Drawing Sheets

(56) References Cited

OTHER PUBLICATIONS

Office Action dated May 31, 2017 in Chinese Patent Application No. 201480041670.6 (with English translation).
Indian Office Action dated Apr. 15, 2019 in Indian Patent Application No. 201947001934.

* cited by examiner

CLAMP APPARATUS

TECHNICAL FIELD

The present invention relates to a clamp apparatus for clamping workpieces on an automated assembly line or the like.

BACKGROUND ART

Heretofore, in an automated assembly line for automobiles, an assembly process has been performed in which clamping is carried out by a clamp apparatus under a condition in which pre-formed frames are positioned in an overlaid manner and the frames are welded together.

In one such clamp apparatus, as disclosed in Japanese Patent No. 4950123, left and right clamp arms are provided as a pair, the clamp arms being disposed for rotation respectively through pins. Further, proximal ends of the clamp arms are supported pivotally by a base to which a drive unit in the form of an air cylinder is connected, whereby distal ends of the clamp arms are operated to open and close. Thus, a workpiece such as a frame or the like is gripped from the left and right by the distal ends of the pair of clamp arms.

SUMMARY OF THE INVENTION

With the clamp apparatus described above, spatter (small metal particulate matter), which is generated during welding when a welding operation is carried out in a clamped condition of a workpiece on an automated assembly line, invades into the interior of the body and becomes deposited therein. Thus, for example, displacement of the base, which is displaced in a downward direction, is hindered, and rotational operation of the clamp arms is interfered with. Therefore, with the clamp apparatus, in general, it is necessary for periodic maintenance operations to be performed in order to remove and dispose of spatter that has become deposited in the interior of the body. However, spatter frequently becomes fixedly attached to the body, and elimination of such spatter is extremely complicated.

A general object of the present invention is to provide a clamp apparatus, which is capable of easily and reliably removing to the exterior spatter that has invaded into the interior of the body.

The present invention is characterized by a clamp apparatus in which, by rotation of a pair of clamp arms, a workpiece is clamped between one of the clamp arms and another of the clamp arms, comprising:

a body;

a drive unit disposed on the body and which outputs a driving force along an axial direction;

a pair of clamp arms supported rotatably on the body, the clamp arms being arranged face-to-face with each other;

a driving force transmission mechanism, which transmits a driving force of the drive unit to the clamp arms to thereby cause rotation of the clamp arms;

a cover member disposed detachably with respect to the body, and which covers the drive unit and a portion of the clamp arms; and an unloading tray disposed inside of the cover member at a position below the clamp arms in the direction of gravity, the unloading tray being removable from the body.

According to the present invention, in the clamp apparatus, the cover member is provided, which is disposed detachably and covers the drive unit and a portion of the clamp arms. Further, the removable unloading tray is disposed inside of the cover member at a position below the clamp arms in the direction of gravity. Consequently, when welding is carried out on workpieces that are clamped by the clamp arms, even in the event that spatter, which is generated accompanying welding, enters into the interior of the body between the clamp arms and the cover member, the welding spatter can be received by and deposited on the unloading tray.

Accordingly, by detaching the detachable cover from the body, and removing the unloading tray on which spatter is deposited, the spatter can easily and reliably be taken out to the exterior of the body and eliminated. As a result, malfunctioning of the drive unit, the driving force transmission mechanism, and the clamp arms due to deposit of spatter thereon can be prevented, clamping of workpieces can be carried out smoothly at all times, and elimination of spatter can be carried out reliably in a short period of time. Therefore, ease of maintenance on the clamp apparatus can be enhanced.

DESCRIPTION OF EMBODIMENTS

Figure 1:
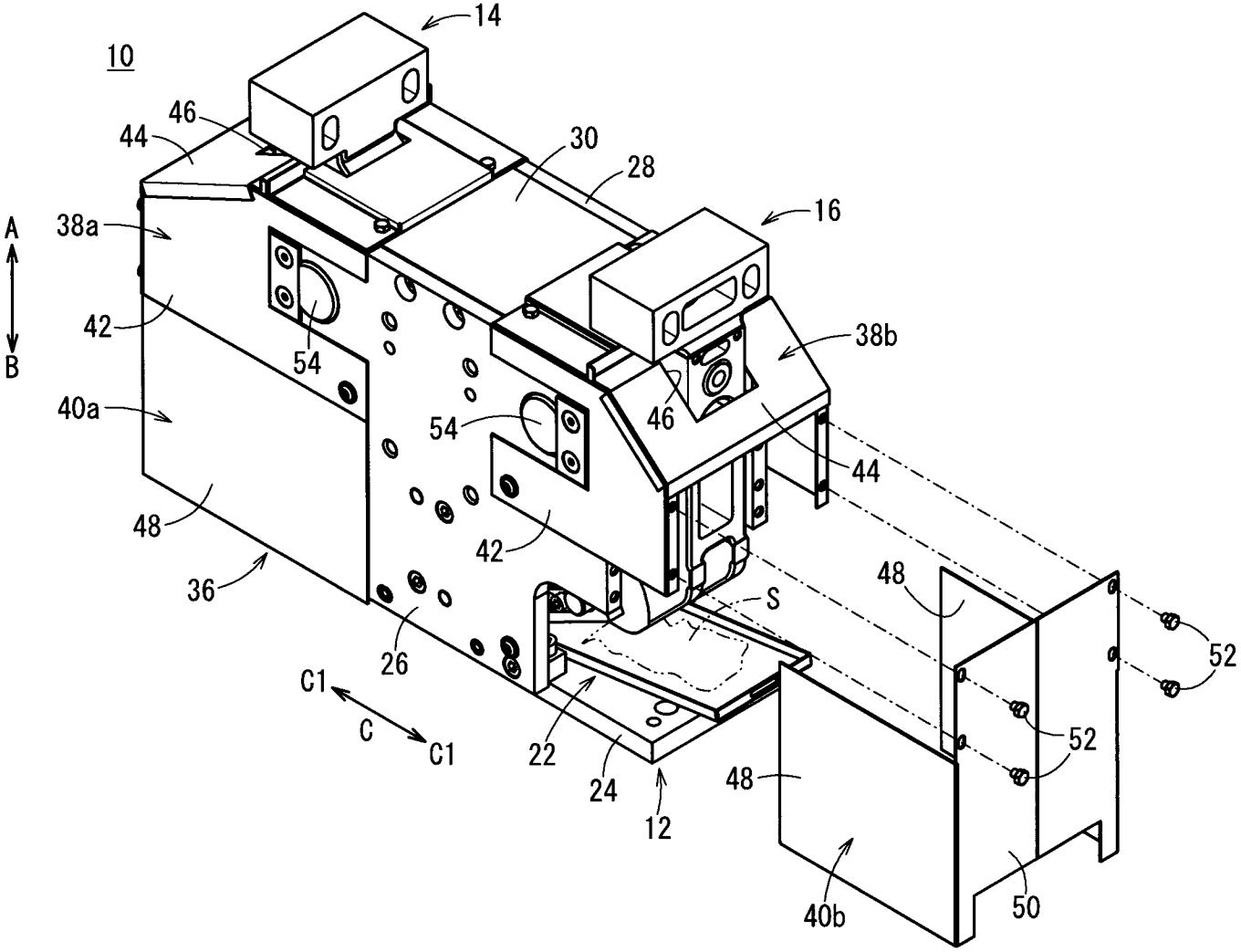
FIG. 1 is a partially exploded external perspective view of a clamp apparatus according to a first embodiment of the present invention, showing a condition in which a portion of a cover of the clamp apparatus is removed.
Figure 2:
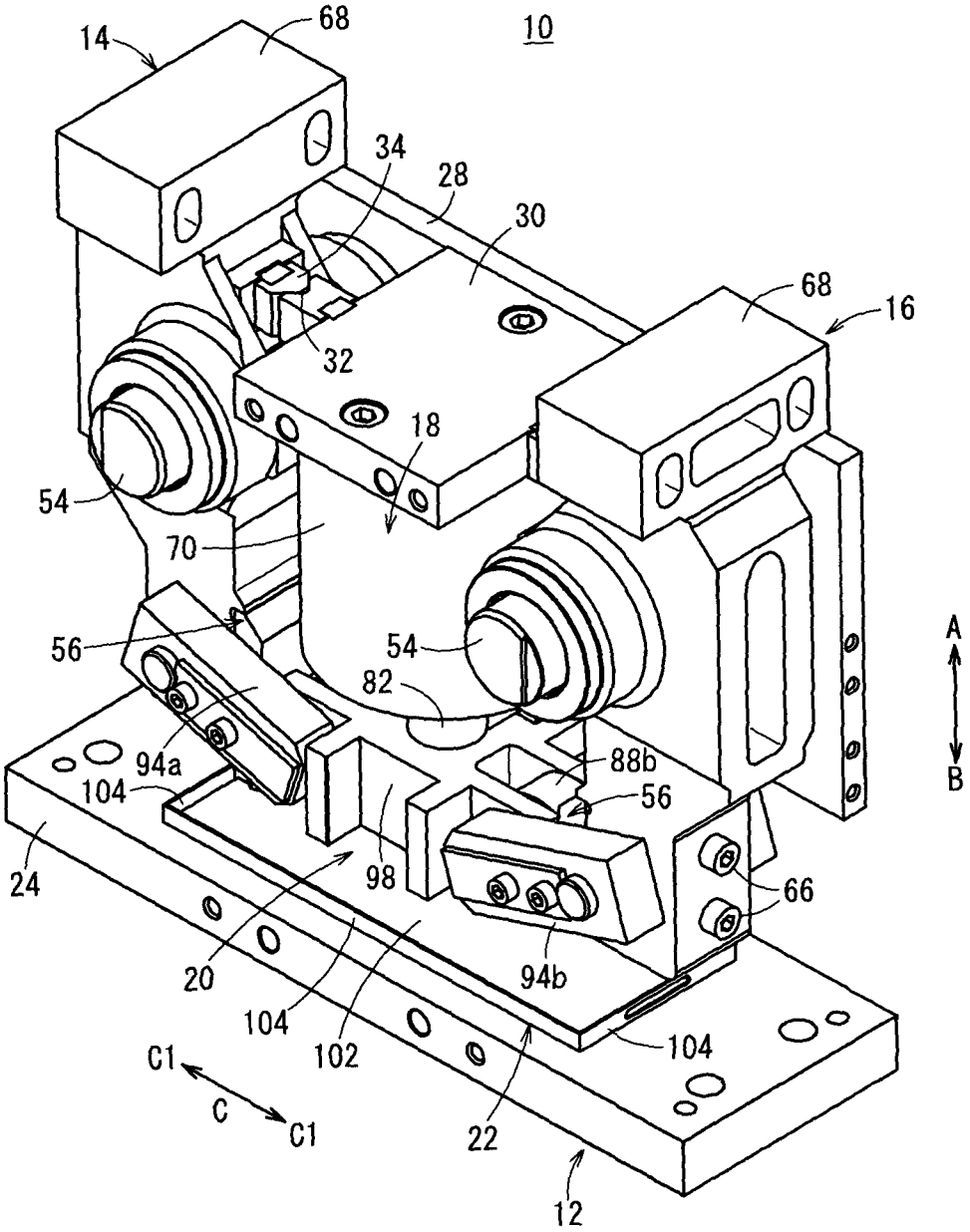
FIG. 2 is an external perspective view showing a condition in which the cover is removed from the clamp apparatus of FIG. 1.
Figure 3:
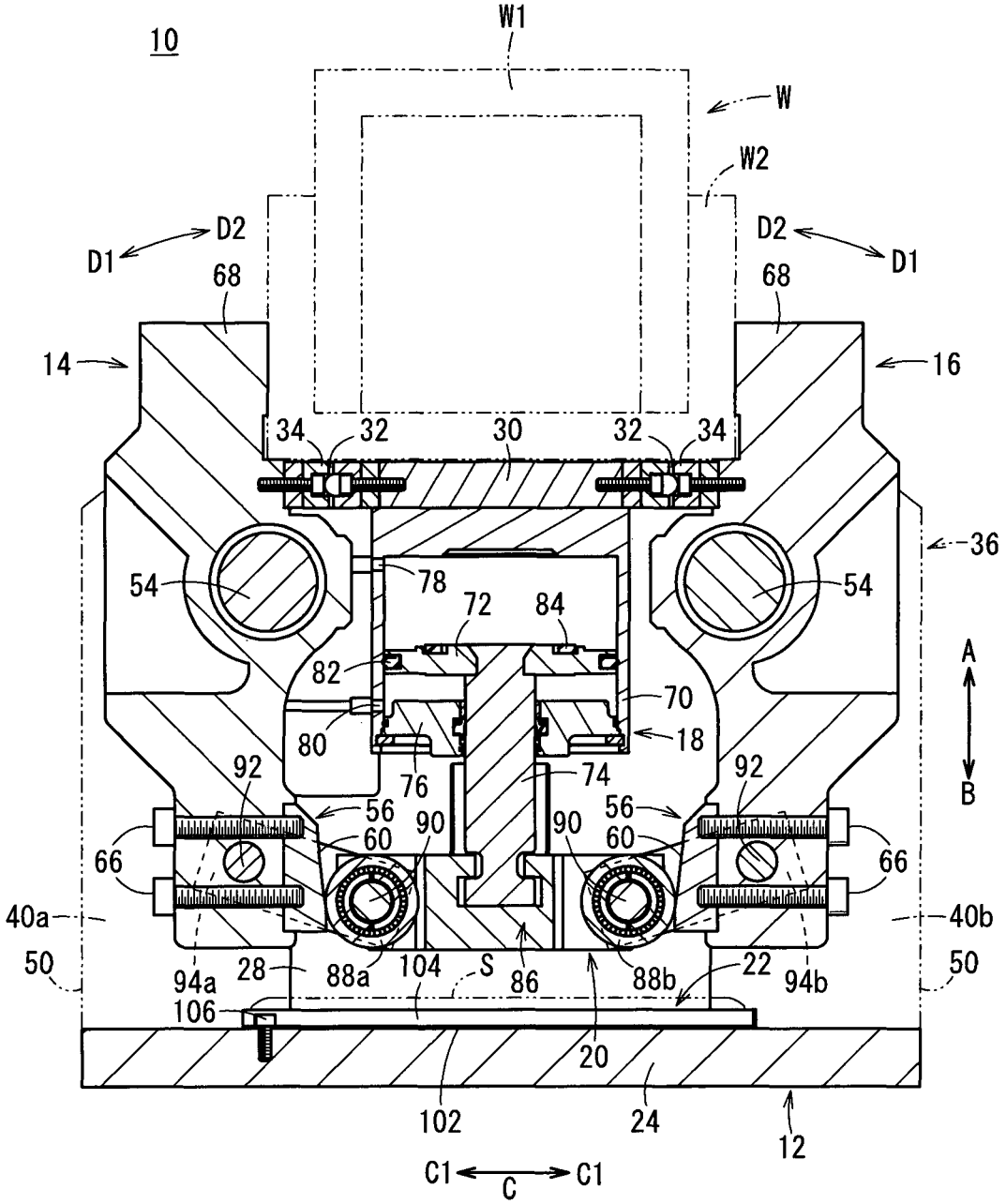
FIG. 3 is an overall cross sectional view of the clamp apparatus shown in FIG. 2.

As shown in FIGS. 1 through 3, a clamp apparatus 10 includes a body 12, first and second clamp arms 14, 16 supported rotatably on the body 12, a drive unit 18 fixed to the body 12, a driving force transmission mechanism 20 that transmits a driving force of the drive unit 18 respectively to the first and second clamp arms 14, 16, and an unloading tray 22 for discharging spatter S and the like that has invaded into the interior of the body 12 and is stored therein.

The body 12, for example, is made up from a base 24, which is formed in a planar shape and is arranged in a horizontal direction, and a pair of first and second plate bodies 26, 28 connected respectively to both side surfaces of the base 24, and which are separated mutually by a predetermined distance. The first and second plate bodies 26, 28 are disposed perpendicularly with respect to the base 24, and are formed with a predetermined upward height (in the direction of the arrow A). Further, the base 24, for example, is mounted on a floor surface or the like, such that the clamp apparatus 10 is fixed in a given location by fixing the base 24 to the floor surface through non-illustrated bolts or the like.

On the other hand, at an upper portion of the body 12, a ceiling portion 30 is connected to upper end parts of the pair of first and second plate bodies 26, 28. The ceiling portion 30 is arranged perpendicularly with respect to a direction of extension (the direction of arrows A and B) of the first and second plate bodies 26, 28, and is disposed on the body 12 substantially centrally in the widthwise direction (the direction of the arrow C) thereof. Stated otherwise, the ceiling portion 30 is disposed substantially in parallel with the base 24.

As shown in FIGS. 2 and 3, on the ceiling portion 30, catch grooves 32, which are V-shaped in cross section, are provided, respectively, on side surfaces thereof that face the later-described first and second clamp arms 14, 16, and positioning portions 34, which are formed on the first and second clamp arms 14, 16, engage with the catch grooves 32. In addition, a workpiece W (see FIG. 3) is placed on an upper surface of the ceiling portion 30 when the workpiece W is gripped by the clamp apparatus 10.

As shown in FIG. 1, the body 12 is equipped with a cover 36, which is disposed in covering relation between the first plate body 26 and the second plate body 28. The cover 36 includes a pair of upper cover portions 38*a*, 38*b* that cover upper portions of the first and second plate bodies 26, 28, and a pair of side cover portions 40*a*, 40*b* that cover lateral end portions of the first and second plate bodies 26, 28.

The upper cover portions 38*a*, 38*b* are formed, for example, by press molding thin plates to be U-shaped in cross section, each of which includes a pair of side walls 42, and an upper wall 44 connected between ends of the side walls 42. In addition, one side wall 42 of each of the upper cover portions 38*a*, 38*b* is fixed to an end of the first plate body 26, whereas the other side wall 42 thereof is fixed to an end of the second plate body 28. Together therewith, the upper walls 44 are disposed and fixed adjacently to ends of the ceiling portion 30.

Further, openings 46, through which other ends of the first and second clamp arms 14, 16 are inserted, open in rectangular shapes respectively on the upper walls 44. Gripping members 68 of the first and second clamp arms 14, 16 project upwardly (in the direction of the arrow A) through the openings 46. Stated otherwise, on the clamp apparatus 10, portions of the first and second clamp arms 14, 16 are exposed outside of the cover 36.

The side cover portions 40*a*, 40*b* are formed, for example, by press molding thin plates to be U-shaped in cross section, each of which includes a pair of side walls 48, and a back surface portion 50 connected between ends of the side walls 48. In addition, on the sides of the clamp apparatus 10, one side wall 48 of each of the side cover portions 40*a*, 40*b* is fixed to an end of the first plate body 26, whereas the other side wall 48 thereof is fixed to an end of the second plate body 28. Together therewith, the back surface portions 50 are fixed respectively to the upper cover portions 38*a*, 38*b* through a plurality of fastening bolts 52.

The first and second clamp arms 14, 16, as shown in FIGS. 2 and 3, are substantially symmetrical, and are disposed on the body 12 between the first plate body 26 and the second plate body 28. The first and second clamp arms 14, 16 are supported rotatably on the body 12, respectively, through arm pins 54, which are inserted substantially in the center along the longitudinal direction of the first and second clamp arms 14, 16.

A pair of cam members 56 are installed, respectively, on mutually confronting side surfaces, on ends that are arranged on the base 24 side (in the direction of the arrow B) of the first and second clamp arms 14, 16.

The cam members 56 are formed in block-like shapes, for example, and are installed through mounting surfaces thereof in recesses formed on side surfaces on the ends of the first and second clamp arms 14, 16. The cam members 56 include cam surfaces (pressing surfaces) 60, which are formed on sides opposite from the mounting surfaces, and are inclined at predetermined angles that gradually narrow toward the other end sides (in the direction of the arrow A) of the first and second clamp arms 14, 16. Further, retention surfaces (not shown) are formed on the cam members 56 adjacent to the cam surfaces 60, and substantially in parallel with the mounting surfaces.

Further, on each of the cam members 56, a pair of screw holes are provided that open on sides of the mounting surfaces, and fastening bolts 66, which are inserted through the one end portions of the first and second clamp arms 14, 16, are screw-engaged in the screw holes. Accordingly, the cam members 56 are disposed detachably through the fastening bolts 66 with respect to the one end portions of the first and second clamp arms 14, 16, in a state in which the mounting surfaces of the cam members 56 are inserted in the recesses, and the cam surfaces 60 are arranged to face toward the center of the clamp apparatus 10.

More specifically, one of the first cam members 56 and the other of the first cam members 56 are arranged substantially symmetrically sandwiching the drive unit 18 therebetween, so that the respective cam surfaces 60 confront one another mutually.

On the other hand, the gripping members 68 for clamping the first workpiece W are formed on the other ends of the first and second clamp arms 14, 16. The gripping members 68 have mutually confronting gripping surfaces, which are substantially rectangular in cross section, and form vertical surfaces that lie substantially in parallel with the longitudinal directions of the first and second clamp arms 14, 16.

Further, the arm pins 54 are provided in the form of shafts, opposite ends thereof being axially supported respectively on the first and second plate bodies 26, 28. The arm pins 54 are inserted, respectively, substantially perpendicular to the longitudinal direction of the first and second clamp arms 14, 16, at positions between the one ends and the other ends of the first and second clamp arms 14, 16. Owing thereto, the first and second clamp arms 14, 16 are rotatably supported on the body 12 through the arm pins 54, which are inserted through substantially central portions of the first and second clamp arms 14, 16.

Furthermore, on the first and second clamp arms 14, 16, respective positioning members 34 are formed below the gripping members 68 and perpendicularly to the longitudinal directions of the first and second clamp arms 14, 16. Additionally, at a time of clamping when the gripping members 68 of the first and second clamp arms 14, 16 are brought into mutual proximity and made to grip the workpiece W, the positioning members 34 abut respectively against the catch grooves 32 that are provided on the ceiling portion 30.

As shown in FIG. 3, the drive unit 18 is arranged between the first plate body 26 and the second plate body 28, and is fixed to the center of the ceiling portion 30. The drive unit 18 includes a bottomed tubular cylinder tube 70, which is fixed with respect to a lower surface of the ceiling portion 30, a piston 72 disposed displaceably in the interior of the cylinder tube 70, a piston rod 74 connected to the piston 72, and a rod cover 76, which is disposed in an opening 46 of the cylinder tube 70 and displaceably supports the piston rod 74.

On a side surface of the cylinder tube 70, first and second ports 78, 80 are formed that penetrate perpendicularly to the axial direction (the direction of arrows A and B) of the cylinder tube 70, such that the first and second ports 78, 80 communicate between the interior and the exterior of the cylinder tube 70. The first port 78 is disposed on one end side (in the direction of the arrow A) of the cylinder tube 70, and the second port 80 is disposed on another end side of the cylinder tube 70 on the side of the rod cover 76 (in the direction of the arrow B).

In addition, the first and second ports 78, 80 are connected through respective couplings to pipes that are connected to a non-illustrated pressure fluid supply source, whereby pressure fluid is supplied selectively to either one of the first port 78 or the second port 80 under a switching action of a non-illustrated switching device.

The piston 72 is formed in a disk-like shape, for example, with a piston packing 82 being installed through an annular groove on an outer circumferential surface thereof. The piston packing 82 slides along an inner circumferential surface of the cylinder tube 70, whereby leakage of the pressure fluid between the piston 72 and the cylinder tube 70 is prevented. Further, on an end surface of the piston 72 that faces the one end of the cylinder tube 70, an annular damper 84 is disposed so as to project from the end surface. Upon displacement of the piston 72 to the side of the ceiling portion 30 (in the direction of the arrow A), the damper 84, which is made of an elastic material such as rubber or the like, comes into abutment against the cylinder tube 70, thereby buffering shocks.

One end of the piston rod 74 is connected by being inserted into and caulked integrally with a center of the piston 72, whereas the other end of the piston rod 74 passes through the rod cover 76 and projects outwardly to the exterior of the cylinder tube 70. A connector, which is once reduced in diameter and then expanded in diameter again, is formed on the other end of the piston rod 74. A block body 86, which makes up part of the driving force transmission mechanism 20, is connected to the connector of the piston rod 74.

The rod cover 76 is inserted into the interior of the cylinder tube 70 and is fixed therein by a locking ring, and the piston rod 74 is inserted for displacement through a rod hole that penetrates through the center of the rod cover 76.

The driving force transmission mechanism 20 includes a block body 86, which is connected to the other end of the piston rod 74, a pair of rollers (pressing members) 88*a*, 88*b* pivotally supported respectively in the vicinity of opposite ends of the block body 86, and a pair of link arms 94*a*, 94*b*, which are supported pivotally between roller pins 90 that pivotally support the rollers 88*a*, 88*b*, and link pins 92 of the first and second clamp arms 14, 16.

The block body 86 extends in a direction (the direction of the arrow C) perpendicular to the axial direction (the direction of arrows A and B) of the piston rod 74, and the connector of the piston rod 74 is engaged with the block body 86 in a center portion thereof. In this manner, the block body 86 is connected in a perpendicular condition with respect to the axial direction of the piston rod 74, and is displaced integrally with the piston rod 74.

Further, the block body 86 has a predetermined length in the longitudinal direction (the direction of the arrow C), opposite ends thereof being formed at equal distances about the axial line of the piston rod 74. Roller pins 90 are disposed as a pair on the opposite ends substantially perpendicular to the direction of extension of the block body 86, and two rollers 88*a*, 88*b* are supported rotatably via the roller pins 90.

The rollers 88*a*, 88*b* are arranged between legs on opposite ends of the block body 86, which are formed in bifurcated shapes, the rollers 88*a*, 88*b* being disposed so as to project from the opposite ends, respectively, toward sides of the first and second clamp arms 14, 16 (see FIG. 3). One of the rollers 88*a* abuts against the cam member 56 of the first clamp arm 14, and the other of the rollers 88*b* abuts against the cam member 56 of the second clamp arm 16.

Furthermore, the link arms 94*a*, 94*b* have a predetermined length in the axial direction, with link grooves (not shown), which open in elongate elliptical shapes along the longitudinal direction, being formed in one end thereof, and the roller pins 90 being inserted respectively through the link grooves. On the other hand, on the other end of the link arms 94*a*, 94*b*, link pins 92, which are axially supported on the one ends of the first and second clamp arms 14, 16, are inserted through holes (not shown).

Owing thereto, the one end sides of the link arms 94*a*, 94*b* are disposed rotatably through the link pins 92 that are inserted through the non-illustrated holes, whereas the other end sides of the link arms 94*a*, 94*b* are movable by predetermined lengths in the longitudinal direction of the block body 86 through the roller pins 90 that are inserted through the link grooves.

Further, the link arms 94*a*, 94*b* are provided as one pair each, on both ends of the block body 86, substantially in parallel sandwiching the rollers 88*a*, 88*b* therebetween.

In addition, by lowering of the block body 86 under a driving action of the drive unit 18, as shown in FIG. 3, the rollers 88*a*, 88*b* are rotated in a state of abutment against the cam surfaces 60 of the cam members 56, and via the cam surfaces 60, the one ends of the first and second clamp arms 14, 16 are pressed by predetermined pressing forces in directions (the directions of the arrows C) to separate mutually away from each other.

On the other hand, in the case that the block body 86 is raised, the one ends of the first and second clamp arms 14, 16 are pulled by the link arms 94*a*, 94*b* in directions to approach each other mutually.

Further, concavely recessed guide grooves 98 are formed on side surfaces of the block body 86 facing toward the first and second plate bodies 26, 28. Guide rails (not shown), which are formed on the first and second plate bodies 26, 28, are inserted respectively into the guide grooves 98, which are rectangular in cross section, for example, and extend in the vertical direction (the direction of arrows A and B). Consequently, when displaced under a driving action of the drive unit 18, the block body 86 is guided in the vertical direction (the direction of arrows A and B).

As shown in FIGS. 1 through 3, the unloading tray 22 has a main body portion 102 formed in a rectangular shape, for example, and four wall portions 104, which are bent at right angles, respectively, on the four sides of the main body portion 102.

In addition, the unloading tray 22 is arranged at a substantially central position on the base 24 below the first and second clamp arms 14, 16 in the direction of gravity (the direction of the arrow B), and the wall portions 104 are arranged so as to extend upwardly on the upper surface of the base 24. One end of the main body portion 102 on the side of the first clamp arm 14 is fixed to the base 24 through a fixing bolt (fixing member) 106 (see FIG. 3). Consequently, the unloading tray 22 is fixed in the condition of being arranged at a position below the first and second clamp arms 14, 16 in the direction of gravity (the direction of the arrow B).

Further, the unloading tray 22 is not limited to a case of being fixed to the base 24 by the aforementioned fixing bolt 106. For example, a claw shaped engagement member may be provided on the base 24, and the unloading tray 22 may be fixed by hooking an end of the unloading tray 22 over the engagement member. In addition, in the case that the base 24 is arranged on a horizontal flat floor surface or the like, the unloading tray 22 may simply be placed in position without the need for a fixing means such as a fixing bolt 106 or the like.

The unloading tray 22, for example, is formed with a width dimension that is greater than the distance along a widthwise direction (the direction of the arrow C) between the openings 46 of the pair of upper cover portions 38*a*, 38*b*.

The clamp apparatus 10 according to the first embodiment of the present invention is constructed basically as described above. Next, operations and advantages of the clamp apparatus 10 will be explained. In the following description, the unclamped condition, in which the gripping members 68 of the first and second clamp arms 14, 16 are separated mutually from each other, will be described as an initial position. In the initial position, pressure fluid is supplied to the second port 80, and a state is assumed in which the piston 72 is raised, whereby the first and second clamp arms 14, 16 are rotated, via the block body 86 and the link arms 94*a*, 94*b* of the driving force transmission mechanism 20, about the arm pins 54 in directions (the directions of the arrows D1) so that the gripping members 68 are separated away from each other.

At first, in a state in which a workpiece W is placed on the ceiling portion 30, under a switching action of a non-illustrated switching device, the pressure fluid, which had been supplied to the second port 80 of the drive unit 18, is supplied instead to the first port 78. Consequently, upon being pressed by the pressure fluid introduced into the cylinder tube 70, the piston 72 is pressed toward the side of the rod cover 76 (in the direction of the arrow B), accompanied by the piston rod 74 and the block body 86 being lowered integrally together with the piston 72.

In addition, the rollers 88*a*, 88*b* descend together with the block body 86, and by the rollers 88*a*, 88*b* being lowered along the cam surfaces 60 of the cam members 56 in abutment therewith, through the cam surfaces 60, the ends of the first and second clamp arms 14, 16 are pressed in directions (the directions of the arrows C1) to separate mutually away from each other. Along therewith, the gripping member 68 of the first clamp arm 14 and the gripping member 68 of the second clamp arm 16 start to rotate in directions (the directions of the arrows D2) to approach one another, whereupon clamping of the workpiece W takes place.

Upon further lowering of the piston 72, and the rollers 88*a*, 88*b* reaching the retention surfaces (not shown) on the cam surfaces 60, a clamped state is brought about in which the workpiece W is clamped at a predetermined clamping force by the gripping members 68 of the first and second clamp arms 14, 16. At this time, further downward displacement of the piston 72 (in the direction of the arrow B) is restricted by abutment of the end of the piston 72 against the rod cover 76.

In the above clamped state, side walls of the first and second frames W1, W2 that make up the workpiece W are welded together, for example, using a non-illustrated welding device.

Next, a case will be described in which, in the above clamp apparatus 10, when welding on the workpiece W is carried out, spatter S invades into the interior of the clamp apparatus 10 from the openings 46 of the upper cover portions 38*a*, 38*b*, and the spatter S, which is deposited in the interior, is eliminated through the unloading tray 22.

Initially, as shown in FIG. 1, the side cover portion 40*b*, which covers side portions of the clamp apparatus 10 and is located on the side of the second clamp arm 16, is removed. More specifically, by screw-rotation and removal of the plural fastening bolts 52, the fixed condition of the side cover portion 40*b* with respect to the side of the upper cover portion 38*b* is released, and the side cover portion 40*b* is moved in a direction (the direction of the arrow C1) to separate away from the first and second plate bodies 26, 28. Consequently, a state is brought about in which the side portion of the clamp apparatus 10 is opened, and the unloading tray 22 can be perceived visually from the exterior.

Next, after the fixing bolt 106 that fixes the unloading tray 22 is unscrewed and the fixed state thereof is released, the unloading tray 22 is moved along the base 24 to the opened side portion, and the unloading tray 22 is taken out to the exterior of the body 12.

In addition, after spatter S, which is deposited on the unloading tray 22 that has been taken out to the exterior of the body 12, is discarded and eliminated, the clean unloading tray 22 is returned again to the predetermined position on the base 24, and is fixed to the base 24 by the fixing bolt 106. Thereafter, the side cover portion 40*b* is once again fixed to the first and second plate bodies 26, 28 by the fastening bolts 52, and the closed condition is restored. Accordingly, the removal operation of deposited spatter S from the interior of the body 12 is completed.

It should be noted that, instead of removing spatter S deposited on the unloading tray 22 and reinstalling the unloading tray 22, the unloading tray 22 may be exchanged and replaced by another new unloading tray. Consequently, it is unnecessary to expend time for eliminating spatter S deposited on the unloading tray 22, and thus the maintenance operation can be completed more swiftly.

In the foregoing manner, with the first embodiment, in the interior of the body 12 that makes up the clamp apparatus 10, the unloading tray 22 is disposed at a position below the first and second clamp arms 14, 16 and/or below the openings 46 of the upper cover portions 38*a*, 38*b* in the direction of gravity (the direction of the arrow B). Consequently, even in the case that spatter S, which passes through the openings 46 when welding is carried out on the workpiece W and falls downwardly through the openings 46 in the direction of gravity, the spatter S is suitably deposited on the unloading tray 22. Therefore, by removing the side cover portion 40*b* of the cover 36, and extracting the unloading tray 22 to the exterior of the clamp apparatus 10, spatter S can easily and reliably be removed to the exterior and eliminated from the interior of the body 12.

As a result, rotation of the first and second clamp arms 14, 16 and stroke displacement of the block body 86 are not impeded due to deposition of spatter S in the interior of the body 12, and clamping of workpieces W can be carried out normally and smoothly. Together therewith, compared to a situation in which the unloading tray 22 is not provided, elimination of spatter S can be carried out more reliably in a short period of time. Therefore, ease of maintenance on the clamp apparatus 10 can be enhanced.

Further, not only spatter S, but other types of debris that invade into the interior of the body 12 can suitably and effectively be removed to the exterior of the body 12 and eliminated through the unloading tray 22.

Furthermore, by modifying the shape of the unloading tray 22 corresponding to the condition in which spatter S is deposited in the interior of the body 12, deposition and adhering of spatter S with respect to the body 12 can be prevented. More specifically, the shape of the unloading tray 22 is not limited to a rectangular shape, insofar as a shape is used that is capable of reliably receiving and enabling removal of spatter S.

Figure 4:
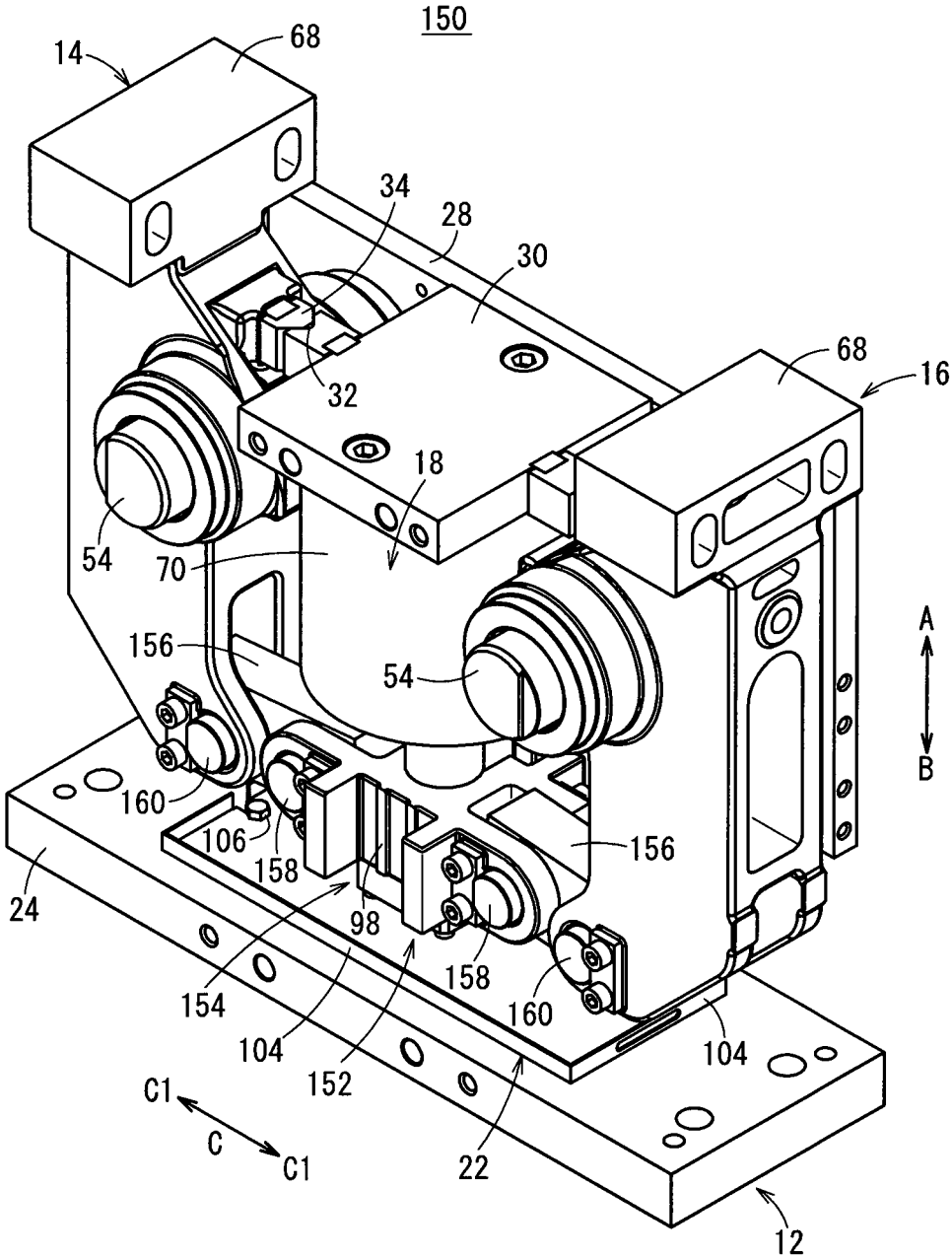
FIG. 4 is an external perspective view showing a condition in which the cover is removed from a clamp apparatus according to a second embodiment of the present invention.
Figure 5:
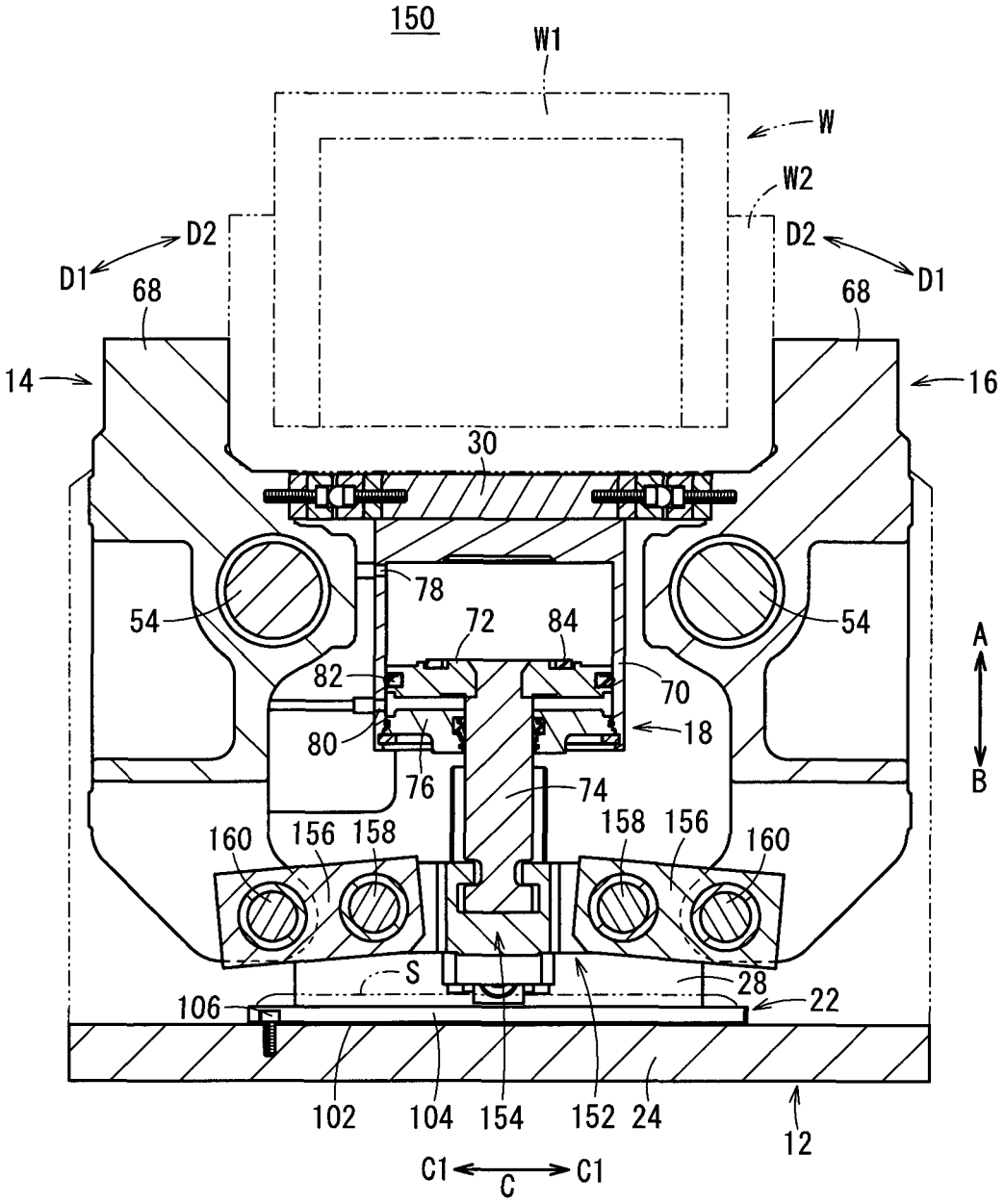
FIG. 5 is an overall cross sectional view of the clamp apparatus shown in FIG. 4.

Next, a clamp apparatus 150 according to a second embodiment is shown in FIGS. 4 and 5. Constituent elements of the clamp apparatus 150, which are the same as those of the clamp apparatus 10 according to the above-described first embodiment, are denoted by the same reference characters, and detailed description of such features is omitted.

The clamp apparatus 150 according to the second embodiment differs from the clamp apparatus 10 according to the first embodiment in that, instead of pressing the cam members 56 with rollers 88*a*, 88*b* that are provided on the block body 86 to thereby cause rotation of the first and second clamp arms 14, 16, as shown in FIGS. 4 and 5, the first and second clamp arms 14, 16 are rotated through link arms 156, which are disposed on a block body (displacement body) 154 that constitutes part of a driving force transmission mechanism 152.

The driving force transmission mechanism 152 of the clamp apparatus 150 includes a pair of first link pins 158, which are inserted respectively in the vicinity of opposite ends of the block body 154 to which the other end of the piston rod 74 is connected, and a pair of link arms 156, which are supported between the first link pins 158 and a pair of second link pins 160 that are provided on the one ends of the first and second clamp arms 14, 16.

In addition, by elevating the block body 154 under the driving action of the drive unit 18, the one ends of the link arms 156 are moved upwardly through the first link pins 158, accompanied by the other ends of the link arms 156 being moved to approach one another mutually. Therefore, the one ends of the first and second clamp arms 14, 16 are pulled toward the center of the body 12, and an unclamped state is brought about in which the first and second clamp arms 14, 16 are rotated so that the gripping members 68 separate mutually.

On the other hand, by lowering of the block body 154 under the driving action of the drive unit 18, the one ends of the link arms 156 are moved downwardly through the first link pins 158, accompanied by the other ends of the link arms 156 being moved to separate away from one another mutually. Therefore, the one ends of the first and second clamp arms 14, 16 are pressed in directions away from each other, and a clamped state is brought about in which the first and second clamp arms 14, 16 are rotated in directions (the directions of the arrows D2) so that the gripping members 68 approach one another mutually.

In the clamp apparatus 150 according to the second embodiment, the unloading tray 22 is disposed inside the cover 36, at a position below the first and second clamp arms 14, 16 in the direction of gravity (the direction of the arrow B). Thus, during a welding operation on the clamped workpiece W, spatter S, which passes through the openings 46 of the cover 36 and invades into the interior, is suitably received by the unloading tray 22 and can be taken out to the exterior and eliminated easily and reliably through the unloading tray 22. In other words, the operation to remove and eliminate spatter can be preformed easily, and maintainability of the camp apparatus 150 can be enhanced.

Irrespective of the structures of the driving force transmission mechanisms 20, 152 in the clamp apparatus 10, 150 according to the first and second embodiments, by providing the unloading tray 22 in the interior of the clamp apparatus, the removal operation for eliminating spatter S that has invaded into the apparatus can be performed easily and reliably.

The clamp apparatus according to the present invention is not limited to the above embodiments. Various changes and modifications may be made to the embodiments without departing from the scope of the invention as set forth in the appended claims.

The invention claimed is:

1. A clamp apparatus in which, by rotation of a pair of clamp arms, a workpiece is clamped between one of the clamp arms and another of the clamp arms, comprising:

a body;

a drive unit disposed on the body and which outputs a driving force along an axial direction;

a pair of clamp arms supported rotatably on the body, the clamp arms being arranged face-to-face with each other;

a driving force transmission mechanism, which transmits a driving force of the drive unit to the clamp arms, to thereby cause rotation of the clamp arms;

a cover member disposed detachably with respect to the body, and which covers the drive unit and a portion of the clamp arms; and an unloading tray disposed inside of the cover member at a position below the clamp arms in the direction of gravity, the unloading tray being removable from the body, wherein the cover member includes openings through which ends of the pair of clamp arms are inserted.

2. The clamp apparatus according to claim 1, wherein, in the cover member, the unloading tray is disposed in facing relation to a pair of openings into which portions of the clamp arms are inserted.

3. The clamp apparatus according to claim 1, wherein the unloading tray is removeably fixed with respect to the body by a fixing member.

4. The clamp apparatus according to claim 1, the driving force transmission mechanism further comprising cam members including pressing surfaces, which are inclined at a predetermined angle with respect to a driving direction of the drive unit, the cam members being disposed detachably with respect to ends of the clamp arms, wherein pressing members of the driving force transmission mechanism abut against the pressing surfaces, and the cam members are pressed by the pressing members.

5. The clamp apparatus according to claim 4, wherein the pressing members comprise rollers, which are rotatably disposed with respect to a displacement body that is displaced linearly under a driving action of the drive unit.

6. The clamp apparatus according to claim 1, the driving force transmission mechanism including a displacement body disposed on an end of the drive unit, and link arms, which are pivotally supported, respectively, on ends of the clamp arms, the driving force of the drive unit being transmitted to the clamp arms through the link arms.

7. The clamp apparatus according to claim 1, the unloading tray comprising:

a main body portion that is formed in a flat shape; and plural wall portions, which are bent respectively on outer edges of the main body portion, wherein on the unloading tray, the wall portions are arranged to extend upwardly.

* * * * *